US006212346B1

(12) United States Patent
Hirabayashi et al.

(10) Patent No.: US 6,212,346 B1
(45) Date of Patent: Apr. 3, 2001

(54) CHARGING MEMBER FOR HOLDING ELECTRICALLY CONDUCTIVE PARTICLES IN CELLS

(75) Inventors: Jun Hirabayashi; Harumi Ishiyama, both of Numazu; Yasunori Chigono, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/387,563

(22) Filed: Sep. 1, 1999

(30) Foreign Application Priority Data

Sep. 4, 1998 (JP) ..... 10-267403

(51) Int. Cl.[7] ..... G03G 15/02
(52) U.S. Cl. ..... 399/176
(58) Field of Search ..... 399/174, 175, 399/176

(56) References Cited

U.S. PATENT DOCUMENTS 5,579,095 * 11/1996 Yano et al. ..... 399/175
5,587,774 * 12/1996 Nagahara et al. ..... 399/176
5,708,932 1/1998 Yano et al. ..... 399/159
6,023,597 * 2/2000 Mayuzumi et al. ..... 399/176

* cited by examiner

*Primary Examiner*—Fred L Braun
(74) *Attorney, Agent, or Firm*—Fitzpatrick, Cella, Harper & Scinto

(57) ABSTRACT

The present invention relates to a charging apparatus in which, when a is a volume resistance value (Ωcm) of an electrically conductive particles, b is a volume resistivity value (Ωcm) of a foam body layer, c is a thickness (cm) of the foam body layer and d is a diameter (cm) of a cell, the following relationship is satisfied:

$$a \leqq bc/10d.$$

8 Claims, 8 Drawing Sheets

CHARGING MEMBER FOR HOLDING ELECTRICALLY CONDUCTIVE PARTICLES IN CELLS

BACKGROUND OF THE INVENTION

1. Field of the Invention

The present invention relates to a charging member and a charging device of contact charging type suitably used with an electrophotographic image forming apparatus.

2. Related Background Art

Conventionally, for example, in image forming apparatuses of electrophotographic or electrostatic type, as a charging device for uniformly charging (including removal of electricity) an image bearing body such as an electrophotographic photosensitive body or an electrostatic recording dielectric body, a corona charger (corona discharger) has been used.

The corona charger is a charging device of non-contact type and has a discharging electrode such as a wire electrode and a shield electrode surrounding the discharging electrode. The corona charger is disposed so that a discharging opening portion is opposed an image bearing body (to be charged) in a non-contact manner, so that a surface of the image bearing body is charged with predetermined potential by exposing the surface of the image bearing member to discharge current (corona shower) generated by applying high voltage to the discharging electrode and the shield electrode.

Recently, as a charging device for charging a body to be charged (such as an image bearing body), many charging devices of contact type have been proposed and put to practical use, since they have advantages of less ozone and low power consumption in comparison with the corona chargers.

In the charging device of contact type, an electrically conductive charging member of roller type (charging roller), fur-brush type, magnet brush type or blade type is contacted with a body to be charged such as an image bearing body, and, by applying predetermined charging bias to the charging member (charging member of contact type, charger of contact type; referred to as "contact type charging member" hereinafter), the surface of the body to be charged is charged with predetermined polarity and potential.

A charging mechanism of contact charging (mechanism of charging, charging principle) including two kinds of charging mechanisms, i.e., (1) discharge charging mechanism and (2) injection charging mechanism, and, independence upon preferential mechanism, various properties are realized.

(1) Discharge Charging Mechanism

In this system, the surface of the body to be charged is charged by a discharging phenomenon caused in a small gap between the contact type charging member and the body to be charged.

Since the discharge charging mechanism has predetermined threshold values for the contact type charging member and the body to be charged, voltage greater than charging potential must be applied to the contact type charging member. Further, although a creating amount of discharge product is considerably small in comparison with the corona charger, since creation of the discharge product cannot be avoided in principle, a bad influence of active ions such as ozone cannot be avoided.

(2) Injection Charging Mechanism

In this system, the surface of the body to be charged is charged by directly injecting electrical charges from the contact type charging member to the body to be charged. This is also referred to as "direct charging" or "injection charging" or "electrical charge injecting charging".

More specifically, a contact type charging member having middle resistance is contacted with the surface of the body to be charged, and the electrical charges are directly injected on the surface of the body to be charged, without a discharging phenomenon, i.e., without using the discharging fundamentally. Thus, even if the voltage applied to the contact type charging member is smaller than the discharging threshold value, the body to be charged can be charged to potential corresponding to the applied voltage. Since the injection charging mechanism does not generate ozone, there is no bad influence of discharge product.

However, due to injection charging, contacting ability of the contact type charging member against the body to be charged greatly influences upon the charging ability. Therefore, the contact type charging member must be made more compact, a difference in speed between the contact type charging member and the body to be charged must be increased, and the contact type charging member must be contacted with the body to be charged more frequently.

The Inventors have proposed a new charging system for effecting the injection charging via electrically conductive particles, as described in U.S. patent application Ser. Nos. 09/035,109, 09/035,108 and 09/035,022, all filed Mar. 5, 1998.

In this charging system, a holding amount of electrically conductive particles can be increased by using a member having a foam body (foam material) layer as a charging member.

However, in the foam material, since a resistance value is varied with the number of cells in the surface of the foam, unevenness of charging potential apt to occur in accordance with the number of cells.

SUMMARY OF THE INVENTION

An object of the present invention is to provide a charging member and a charging apparatus, in which electrically conductive particles can be held in cells of a foam body surface layer.

Another object of the present invention is to provide a charging apparatus in which unevenness corresponding to the number of cells of foam body does not occur.

A further object of the present invention is to provide a charging apparatus comprising a body to be charged, a charging member contacted with the body to be charged and adapted to charge the body to be charged and having a foam body layer at a surface thereof, and electrically conductive particles held in cells of the foam body layer, wherein, when a is a volume resistivity value (Ωcm) of the electrically conductive particles, b is a volume resistivity value (Ωcm) of the foam body layer, c is a thickness (cm) of the foam body layer and d is a diameter (cm) of the cell, the following relationship is satisfied:

$$a \leqq bc/10d.$$

A still further object of the present invention is to provide a charging member comprising an electrically conductive core member, and a foam body surface layer having cells holding electrically conductive particles, wherein a relationship $bc/10d \geqq a$ is satisfied.

The other objects and features of the present invention will be apparent from the following detailed explanation of the invention.

DETAILED DESCRIPTION OF THE PREFERRED EMBODIMENTS

<First Embodiment> (FIGS. 1 to 6)

Figure 1:
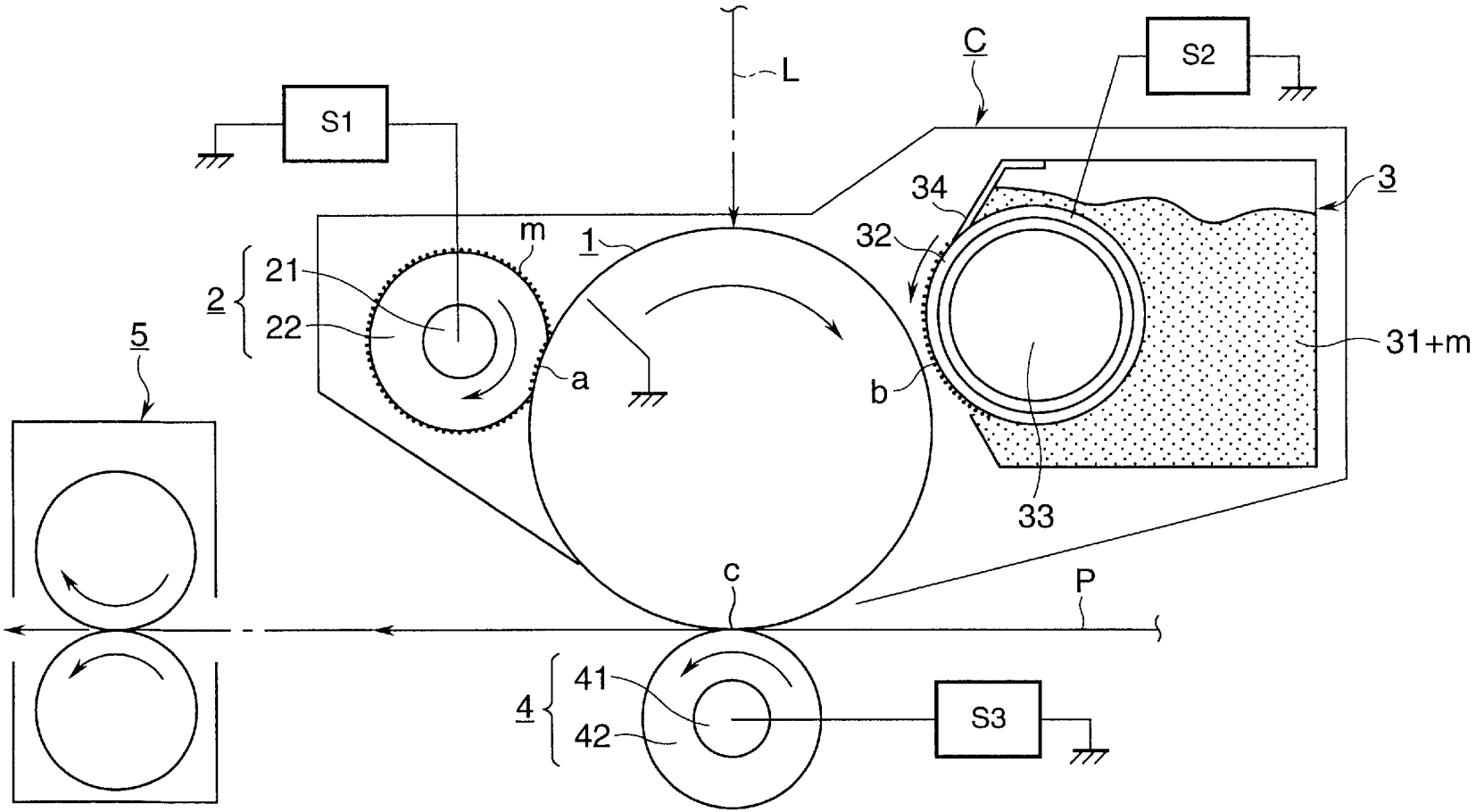
FIG. 1 is a schematic constructural view of an image forming apparatus according to a first embodiment of the present invention.

FIG. 1 is a schematic constructural view of an image forming apparatus according to the present invention.

The image forming apparatus according to the illustrated embodiment is embodied as a laser beam printer which uses a transfer electrophotographic process and is of contact charging type, reversal developing type, cleanerless type and process cartridge type.

(1) Schematic entire construction of printer

[Image bearing body]

An image bearing body (body to be charged) 1 is embodied as a rotating drum-type electrophotographic photosensitive member. The printer according to the illustrated embodiment utilizes a reversal development, and negative photosensitive body is used in the photosensitive member 1. The photosensitive body 1 according to the illustrated embodiment is an OPC photosensitive body having a diameter of 30 mm and is rotatingly driven at a peripheral speed of 94 mm/sec in a clockwise direction shown by the arrow.

[Charging]

An electrically conductive elastic sponge roller (charging roller) 2 as a contact type charging member having a porous member is urged against the photosensitive body 1 with a predetermined urging force. A charging nip portion (nip portion) a is formed between the photosensitive body 1 and the charging roller 2. Charge accelerating particles m are previously coated to be born on a peripheral surface of the charging roller 2 so that the charge accelerating particles m exist in the charging nip portion a.

In the illustrated embodiment, the charging roller 2 is rotatingly driven at a peripheral speed of 100% in a direction (counter direction) opposite to the rotational direction of the photosensitive body 1 at the charging nip portion a and is contacted with the surface of the photosensitive body 1 with speed difference.

Predetermined charging bias is applied to the charging roller 2 from a charging bias power source S1. As a result, the peripheral surface of the rotating photosensitive body 1 is uniformly contact-charged with predetermined polarity and potential by an injection charging mechanism.

In the illustrated embodiment, the charging bias from the charging bias power source S1 is applied to the charging roller 2 so that the peripheral surface of the photosensitive body 1 is uniformly charged to about −700 Volts.

The charging roller 2, charge accelerating particles m and injection charging will be fully described later.

[Exposure]

Scan exposure L using a laser beam outputted from a laser beam scanner (not shown) including a laser diode, a polygon mirror and the like is effected with respect to the charged surface of the rotating photosensitive body 1. The laser beam outputted from the laser beam scanner is intensity-modulated in response to a time-series electric digital pixel signal of target image information, and, by the scan exposure L of the laser beam, an electrostatic latent image corresponding to the target image information is formed on the outer peripheral surface of the photosensitive body 1.

In the illustrated embodiment, reversal development is used, so that, in the scan exposure L of the laser beam regarding the outer peripheral surface of the photosensitive body 1, an exposed portion becomes an image portion and a non-exposed portion becomes a non-image portion.

[Development]

In the illustrated embodiment, a developing device 3 is of reversal non-contact type in which negatively charged magnetic one-component developer having an average particle diameter of 6 $\mu$m is used as developer 31.

The electrostatic latent image formed on the outer peripheral surface of the photosensitive body 1 is reverse-developed as a developer image (toner image) by the developing device 3 by adhering the developer (toner) to the exposed portion.

The developing device includes a non-magnetic developing sleeve (developer bearing and carrying member) 32 having diameter of 16 mm, a magnet roller (magnetic field generating means) 33 fixedly disposed within the developing sleeve 32, and a developer layer thickness regulating elastic blade 34 for forming a thin developer layer on the surface of the developing sleeve.

The developing sleeve 32 is disposed so that a minimum distance (gap distance) between the photosensitive body 1 and the developing sleeve becomes about 500 $\mu$m and is rotatingly driven around the fixed magnet roller 33 at a constant speed in a direction opposite to the rotational direction of the photosensitive body 1 at a developing station.

Developing bias voltage is applied to the developing sleeve 32 from a developing bias power source S2. In the illustrated embodiment, the developing bias voltage is obtained by overlapping DC voltage of 380 V with rectangular AC voltage having frequency of 1800 Hz and peak-to-peak voltage of 1600 V.

The developer 31 is absorbed or adhered to the outer surface of the developing sleeve 32 by a magnetic force of the magnet roller 33, thereby forming a magnet brush of developer 31. The magnet brush of developer is conveyed as the developing sleeve 32 is rotated; meanwhile, the magnet brush is triboelectrically charged by the sliding contact between the developer and the elastic blade 34 to possess charges, and a developing layer having a predetermined thickness is formed on the developing sleeve by the elastic blade 34 and then is carried or conveyed to a developing station b. In the developing station b, a one-component jumping development is effected between the developing sleeve 32 and the photosensitive body 1. A portion of the developer layer which was not used in development is returned to the developing container again as the developing sleeve 32 is further rotated.

The charge accelerating particles m are mixed with the developer 31, and a mixing ratio of the charge accelerating particles to the developer is 2:100 in part by weight.

[Transferring]

An middle resistance transfer roller (contact type transferring means) 4 is urged against the photosensitive body 1 to form a transfer portion c therebetween. A transfer material (recording medium) P is fed to the transfer portion c from a sheet feeding portion (not shown) at a predetermined timing, and, at the same time, by applying predetermined transfer bias to the transfer roller 4 from a transfer bias power source S4, developer images on the photosensitive body 1 are successively transferred onto the transfer material P.

The transfer roller 4 used in the illustrated embodiment is constituted by a core metal 41, and an middle resistance elastic layer 42 formed on the core metal and has a roller resistance value of $5\times10^8\Omega$.

The transferring is effected by applying DC voltage of +3000 V to the metal core 41. While the transfer material P introduced into the transfer portion c is being pinched and conveyed through the transfer portion, the developer image born on the rotating photosensitive body 1 is transferred onto the transfer material by an electrostatic force and an urging force.

[Fixing]

The transfer material P to which the developer images (from the photosensitive body 1) were transferred is separated from the surface of the rotating photosensitive body 1 and then is introduced into a fixing device 5 of thermal fixing type, where the developer images are fixed to the transfer material. Thereafter, the transfer material is discharged out of the image forming apparatus as an imaged matter (print or copy).

[Cartridge]

In the printer according to the illustrated embodiment, three process equipments, i.e., photosensitive body 1, charging roller 2 and developing device 3 are contained within a cartridge case to form a cartridge C which is detachably attachable to a main body of the printer. The combination of the process equipments is not limited to the above-mentioned one.

(2) Charging roller 2

The charging roller 2 as the contact type charging member according to the illustrated embodiment is an electrically conductive elastic sponge roller constituted by a core metal 21, and a middle resistance layer 22 made of foam material (porous member) and coated on the core metal.

The middle resistance layer (porous member) 22 is prescribed by resin (urethane, in the illustrated embodiment), electrically conductive particles (for example, carbon black), sulfurizing agent and foaming agent and is formed on the core metal as a roller-shaped body. Thereafter, the surface of the roller is polished.

It is important that the charging roller (contact type charging member) 2 is also acts as an electrode. Namely, it is required that the charging roller has elasticity to be fully contacted with the body to be charged, and, at the same time, it has sufficiently low resistance to permit charging of the moving body to be charged. On the other hand, if there is low pressure resistance defect portion such as pin hole in the body to be charged, leakage of voltage must be prevented. When an electrophotographic photosensitive body is used as the body to be charged, resistance of $10^4$ to $10^7\Omega$ is desirable to obtain adequate charging ability and prevention of leakage.

Regarding hardness of the charging roller 2, if the hardness is too low, since the shape of the roller becomes unstable, the contacting ability against the body to be charged is worsened, and, if the hardness is too great, not only the charging nip portion a cannot be maintained between the body to be charged and the charging roller but also microscopic contacting ability against the surface of the body to be charged is worsened. Thus, the hardness of the charging roller is preferably within a range between 25 degrees and 50 degrees (Asker C hardness).

The material of the charging roller 2 is elastic body such as foam body made of EPDM, urethane, NBR, silicone rubber or material obtained by dispersing electrically conductive substance such as carbon black or metal oxide (for adjusting the resistance) in IR. Alternatively, the resistance may be adjusted by using ion electrically conductive material particularly without dispersing the electrically conductive substance.

The charging roller 2 is urged against the photosensitive body with a predetermined urging force in opposition of elasticity of the roller itself. In the illustrated embodiment, the charging nip portion a having a width of several millimeters is formed.

The resistance value of the charging roller 2 is measured as follows. The photosensitive body 1 of the printer is replaced by an aluminum drum. Thereafter, voltage of 100 Volts is applied between the aluminum drum and the core metal 21 of the charging roller 2. By measuring a value of current flowing in this case, the resistance value of the charging roller 2 is determined, and, on the basis of a contacting nip between the roller and the aluminum drum and a distance between the core metal and the aluminum drum, a volume resistivity value is determined.

In the illustrated embodiment, the resistivity value of the charging roller 2 determined in this way was $1\times10^6$ Ω·cm to $1\times10^8$ Ω·cm. The resistivity measurement was effected under an environment of a temperature of 25° C. and humidity of 60%. In other embodiments, the measurement environment is the same as that in the first embodiment.

Further, in the charging roller 2 used in the illustrated embodiment, an average cell diameter (average pore diameter) of cells in the surface of the electrically conductive elastic sponge roller is 100 μm. The average cell diameter on the surface of the charging roller 2 was measured by using an optical microscope.

(3) Charge accelerating particles m

In the illustrated embodiment, as the charge accelerating particles m previously coated on the outer peripheral surface of the charging roller 2 and added to the developer 31 of the developing device 3, electrically conductive zinc oxide particles having specific resistance of $10^7$ to $10^{12}$ Ω·cm and average particle diameter of 1 μm are used.

There is no problem even when the charge accelerating particles is not only in a primary particle condition but also in a secondary particle cohered condition. Whatever cohered condition may be, so long as the function of the charge accelerating particles in the aggregated condition can be realized, the condition of the particles is not critical.

When the particles form an cohered matter, the particle diameter is defined as an average particle diameter of the cohered matter. In the measurement of the particle diameter, by observing the optical or electronic microscope, 100 or more particles are picked up, and volume particle size distribution on the basis of a horizontal maximum arc length is calculated, and the particle diameter is determined on the basis of 50% average particle diameter.

Incidentally, the measurement of the average cell diameter (average pore diameter) of cells in the surface of the charging member 2 having the porous surface is effected in the similar manner to the measurement of the particle diameter of the charge accelerating particles m.

It was found that, when the resistivity value of the charge accelerating particles m is greater than $10^{12}$ Ω·cm, the charging ability is worsened. Thus, the resistivity value must be smaller than $10^{12}$ Ω·cm and more preferably be smaller than $10^{10}$ Ω·cm. In the illustrated embodiment, the resistivity value is selected to $1\times10^7$ Ω·cm.

The resistance measurement is measured by a tablet method and is sought by normalization. That is to say, powder specimen of about 0.5 gram is contained in a cylinder having a bottom area of 2.26 $cm^2$, and the resistivity value is measured by pressurizing upper and lower electrodes with 15 kg and at the same time by applying voltage of 100 V to the electrodes, and thereafter, by normalization, specific resistance is calculated.

The charge accelerating particles m is desirably white or transparent not to obstruct the exposure of the latent image, and, thus, is desirably non-magnetic. Further, in consideration of the fact that the charge accelerating particles are partially transferred from the photosensitive body onto the transfer material P, in the color recording, the white or transparent charge accelerating particles are desirable. Further, if the particle diameter of the charge accelerating particles is not smaller than ½ of the particle diameter of the developer 31, the image exposure may be obstructed. Thus, the particle diameter of the charge accelerating particles m is desirably smaller than ½ of the particle diameter of the developer 31. A lower limit of the particle diameter may be 10 nm to obtain the particles stably.

In the illustrated embodiment, while an example that the charge accelerating particles m are made of zinc oxide was explained, the present invention is not limited to such an example, but the charge accelerating particles may be electrically conductive inorganic particles of other metal (for example, aluminum) oxide, electrically conductive particles of mixture of inorganic and organic materials, or various electrically conductive particles subjected to surface treatment.

(4) Injection charging

<1> The charge accelerating particles coated on the electrically conductive elastic sponge roller (charging roller) 2 and the charge accelerating particles supplied from the developing device 3 to the charging nip portion as will be described later are pushed into and held by foam cells in the sponge roller. As a result, the charge accelerating particles m having small particle diameter exist compactly in the charging nip portion (nip portion) a between the photosensitive body (image bearing body) 1 and the charging roller (contact type charging member) 2. Due to lubricating effect of the particles m, even a charging roller having great frictional resistance so that it is difficult to contact the charging roller with the photosensitive body 1 with difference in speed, such a charging roller can reasonably be contacted with the photosensitive body 1 with difference in speed easily and effectively, and the charging roller is compactly contacted with the surface of the photosensitive body 1 via the particles m, thereby contacting with the surface of the photosensitive body 1 more frequently.

By providing adequate difference in speed between the charging roller 2 and the photosensitive body 1, in the nip portion a between the charging roller 2 and the photosensitive body 1, a chance that the charge accelerating particles m are contacted with the photosensitive body 1 is considerably increased, thereby obtaining high contacting ability. Accordingly, since the charge accelerating particles m existing in the charging nip portion (nip portion) a between the charging roller 2 and the photosensitive body 1 slidingly contact with the surface of the photosensitive body 1 without creating any void, the charges can be injected into the photosensitive body 1 directly, with the result that, in the contact charging of the charging roller 2 with respect to the photosensitive body 1, the injection charging mechanism becomes preferential due to the presence of the charge accelerating particles m therebetween.

The difference in speed between the photosensitive body 1 and the charging roller is achieved by rotatingly driving the charging roller 2. Preferably, in order to temporarily collect the transfer-residual developer (on the photosensitive body 1) brought into the charging nip portion a onto the charging roller 2 to make the toner uniform, the charging roller 2 is rotatingly driven. In this case, it is desirable that the rotational direction of the charging roller is selected to be opposite to the moving direction of the surface of the photosensitive body 1. That is to say, by temporarily separate the transfer-residual developer from the photosensitive body 1 by the counter rotation, the injection charging can be effected preferentially.

Accordingly, high charging efficiency which could not obtained by the conventional techniques can be obtained, and substantially the same charging potential as the voltage applied to the charging roller 2 can be given to the photosensitive body 1.

Thus, even when the charging roller 2 is used as the contact type charging member, it is adequate that the applied bias required to charge the charging roller 2 is voltage corresponding to charging potential required for the photosensitive body 1, thereby realizing a stable and safe contact type charging system or device without using the discharging phenomenon.

<2> In the image forming apparatus of cleanerless type, the transfer-residual developer remaining on the surface of the photosensitive body 1 after the transferring is brought into the charging nip portion (nip portion) a between the photosensitive body 1 and the charging roller 2 as it is.

In this case, by contacting the charging roller 2 with the photosensitive body 1 with difference in speed, a pattern of the transfer-residual developer is disturbed and destroyed, with the result that, in a halftone image, there does not arise a phenomenon that a previous image pattern generates ghost.

<3> The transfer-residual developer brought into the charging nip portion a is adhered and mixed to the charging roller 2. Since the conventional developer is insulative, the adhesion of the transfer-residual developer onto the charging roller 2 caused poor charging of the photosensitive body 1.

However, also in this case, due to presence of the charge accelerating particles m in the charging nip portion (nip portion) a between the photosensitive body 1 and the charging roller 2, since the compact contacting ability and contact resistance of the charging roller 2 with respect to the photosensitive body 1 can be maintained, in spite of contamination of the transfer-residual developer on the charging roller 2, the direct ozoneless charging with low applied voltage can be stably maintained for a long term, thereby providing uniform charging ability.

<4> The transfer-residual developer adhered to the charging roller 2 is gradually shifted or exhaled from the charging roller 2 to the photosensitive body 1 and then is brought into the developing station b as the photosensitive body 1 is rotated and then is subjected to cleaning simultaneous with development (collected) (toner recycle).

In this case, since the charge accelerating particles m are born on the charging roller 2, an adhering force between the charging roller 2 and the transfer-residual developer adhered and mixed to the charging roller is decreased, thereby improving the efficiency of transferring the developer from the charging roller 2 to the photosensitive body 1.

As mentioned above, in the cleaning simultaneous development, the toner remaining on the photosensitive body 1 after the transferring is collected by fog removing bias of the developing device, i.e., fog removing potential Vback (potential between DC voltage applied to the developing device and surface potential of the photosensitive body) in the development of the subsequent image forming process (i.e., when the photosensitive body is charged and exposed subsequently to form a latent image and such a latent image is developed). In case of the reversal development as is in the printer according to the illustrated embodiment, the cleaning simultaneous development is effected by actions of an electric field for collecting the toner from the dark portion potential of the photosensitive body onto the developing sleeve and an electric field for adhering the toner from the developing sleeve onto the bright portion potential of the photosensitive body.

<5> Due to the presence of the charge accelerating particles m substantially adhered to and held on the surface of the photosensitive body 1, it is considered that the transfer efficiency for transferring the developer from the photosensitive body 1 to the transfer material P is improved.

(5) Supplying of charge accelerating particles m from developing device 3 to charging nip portion a Even when an adequate amount of charge accelerating particles m are previously located in the charging nip portion (nip portion) a between the photosensitive body 1 and the charging roller 2 or even when an adequate amount of charge accelerating particles m are previously coated on the charging roller 2, as the apparatus is used for a long term, the charge accelerating particles m may be gradually decreased from the charging nip portion (nip portion) a between the photosensitive body 1 and the charging roller 2.

In the illustrated embodiment, the charge accelerating particles m are previously mixed with the developer 31 in the developing device 3, and the charge accelerating particles m are supplied to the surface of the photosensitive body 1 by the developing device 3 to supply the charge accelerating particles m to the charging nip portion (nip portion) a between the photosensitive body 1 and the charging roller 2, and the charging roller 2. That is to say, the charge accelerating particles m added to and mixed with the developer 31 in the developing device 3 are adhered to the surface of the photosensitive body 1 in the development of the electrostatic latent image on the photosensitive body, and, as the photosensitive body 1 is rotated, the charge accelerating particles are brought and supplied to the charging nip portion a through the transfer nip portion c. Incidentally, although the developer image (toner image) on the photosensitive body 1 is positively shifted to the transfer material P by the transfer bias at the transfer nip portion c, since the charge accelerating particles m have the low resistivity value, the charge accelerating particles are not shifted to the transfer material P positively but are substantially adhered to the photosensitive body 1, so that, as the photosensitive body 1 is rotated, they are brought and supplied to the charging nip portion a through the transfer nip portion c.

(6) As for a $\leqq[(b\times c)/(10\times d)]$

As mentioned above, when the resistivity value of the charge accelerating particles m is low, if there is defect on the surface of the photosensitive body 1, the defect portion and therearound cannot be charged, thereby creating pin hole leak. Further, if the charge accelerating particles m enter into the developing device 3, the charging amount of the developer 31 is reduced, thereby deteriorating the image. Further, although the charge accelerating particles are held on the sponge roller, by possessing triboelectricity having polarity opposite to that of the applied bias to the charge accelerating particles, the consumption of the charge accelerating particles can be suppressed.

In order to avoid such problems, it is desirable to increase the resistivity value of the charge accelerating particles m. However, if the resistivity value of the charge accelerating particles is greater than the volume resistivity value of the sponge roller by ten times or more, the following problem will arise.

Difference between the resistivity value from the core metal 21 at an area where the surface of the electrically conductive elastic sponge roller (charging roller) is contacted with the photosensitive body 1 directly or in a similar condition, i.e., "direct contact resistivity value A" and the resistivity value from the core metal 21 at an area where the surface of the electrically conductive elastic sponge roller is contacted with the photosensitive body via the charge accelerating particles m in the cells of the surface of the electrically conductive elastic sponge roller, i.e., "indirect contact resistivity value B" becomes noticeable, thereby causing unevenness in the charging ability.

Figure 2:
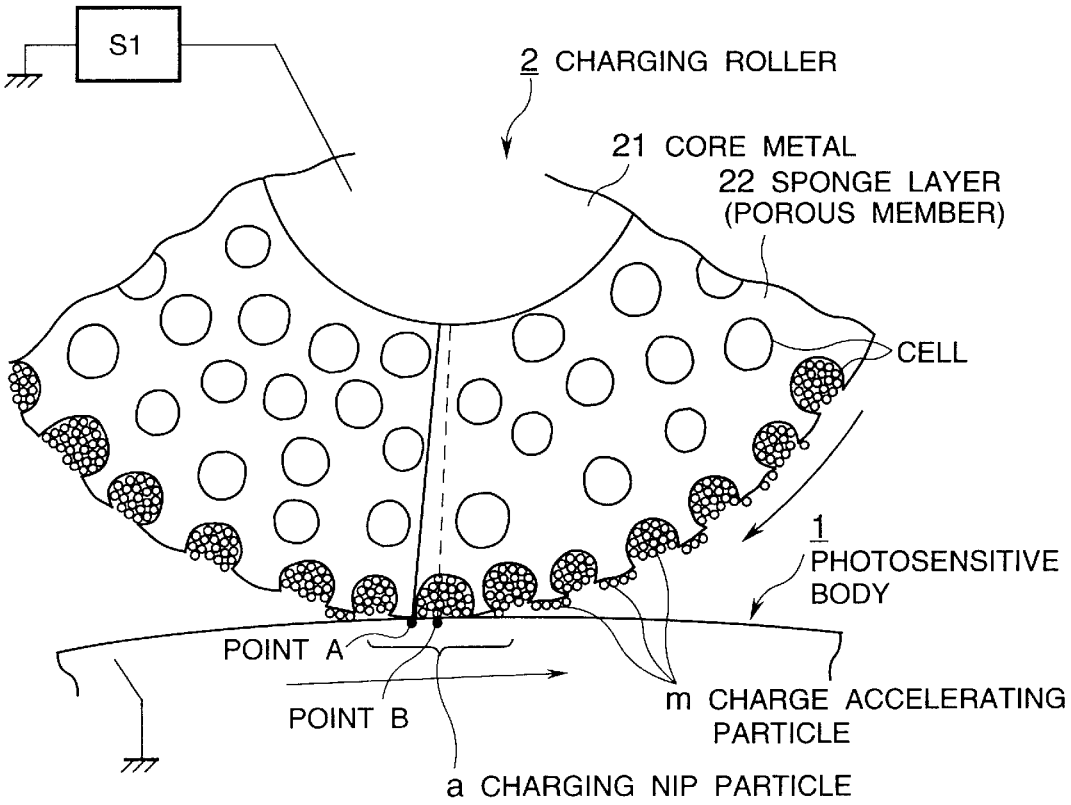
FIG. 2 is a schematic partial enlarged view of a charging nip portion and therearound.

Such a condition is shown in FIG. 2. In FIG. 2, at a point A, the resistivity value from the core metal 21 is in a direct contact resistivity value A condition, and, at a point B, the resistivity value from the core metal 21 is in an indirect contact resistivity value B condition. If the direct contact resistivity value A differs from the indirect contact resistivity value B greatly, there arises a difference between the charged conditions, thereby generating unevenness in the charging ability.

In the illustrated embodiment, by reducing the difference between the direct contact resistivity value A and the indirect contact resistivity value B, the unevenness in the charging ability is prevented. Further, by increasing the resistivity value of the charge accelerating particles m within this range, the pin hole leak and deterioration of the image in the developing portion can be prevented.

That is to say, when it is assumed that the volume resistivity value of the charge accelerating particles (electrically conductive particles) m is a (Ω·cm), the volume resistivity value (volume resistivity value of porous member) of the sponge layer (porous member) 22 of the charging roller 2 is b (Ω·cm), a thickness of the sponge layer 22 (thickness of porous roller) is c (cm) and a pore diameter of the sponge layer 22 (pore diameter of porous roller) is d (cm), the above problem is solved by providing a charging member satisfying the following relationship:

$$a\leqq[(b\times c)/(10\times d)]$$

In order to reduce the difference between the direct contact resistivity value A and the indirect contact resistivity value B to the extent not affecting an influence upon the charging ability, the direct contact resistivity value A: (1) the resistivity value of the electrically conductive elastic sponge roller 22 from the core metal 21 to the vicinity of the surface of the photosensitive body 1 may be substantially equal to the indirect contact resistivity value B: (1)+(2) the resistivity value of the charge accelerating particles from the outer periphery of each cell to the vicinity of the center of each cell. When (2) is smaller than (1), for example, by 1/10 or less, the difference between the direct contact resistivity value A and the indirect contact resistivity value B becomes 10% or less, thereby improving the charging stability.

The resistivity value (1) of the electrically conductive elastic sponge roller 22 from the core metal 21 to the vicinity of the surface of the photosensitive body 1 is proportional to the volume resistivity value (Ω·cm) of the roller 2 and a thickness (cm) of the roller. When these values are great, the resistivity value (2) may have a relatively great value and the resistivity value of the charge accelerating particles may be great.

Further, when the cell diameter of the roller is small, since the resistivity value (2) of the charge accelerating particles from the outer periphery of each cell to the vicinity of the center of each cell becomes small, similarly, the resistivity value of the charge accelerating particles may be great.

Accordingly, it can be understood that the preferred resistivity value of the charge accelerating particles is proportional to the volume resistivity value (Ω·cm) of the roller and the thickness (cm) of the roller and is in inverse proportion to the cell diameter of the roller.

Figure 3:
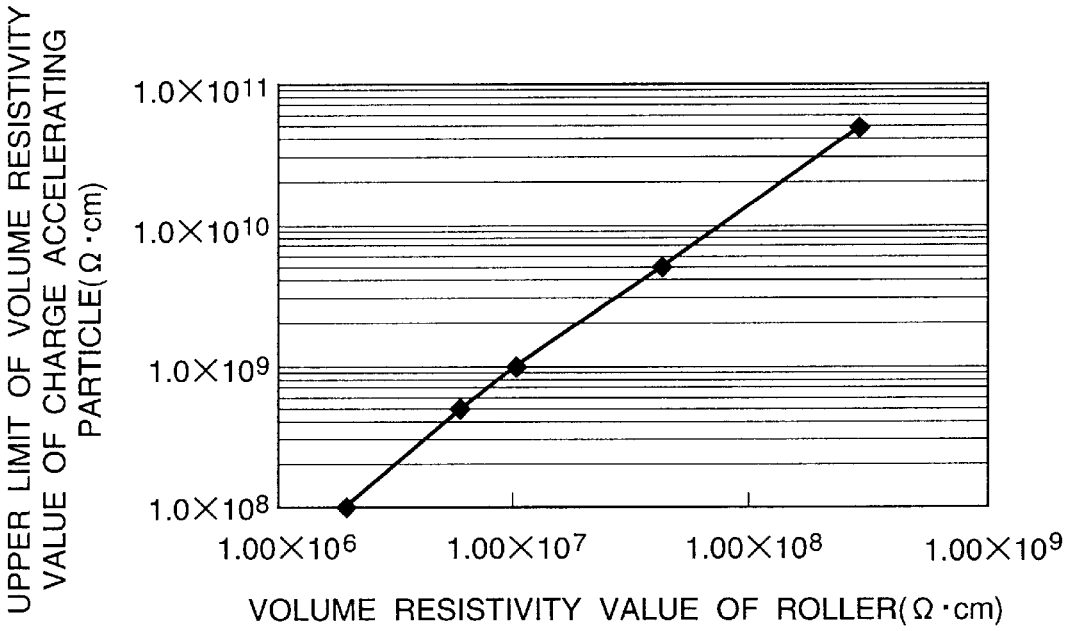
FIG. 3 is a correlative view (No. 1)
Figure 4:
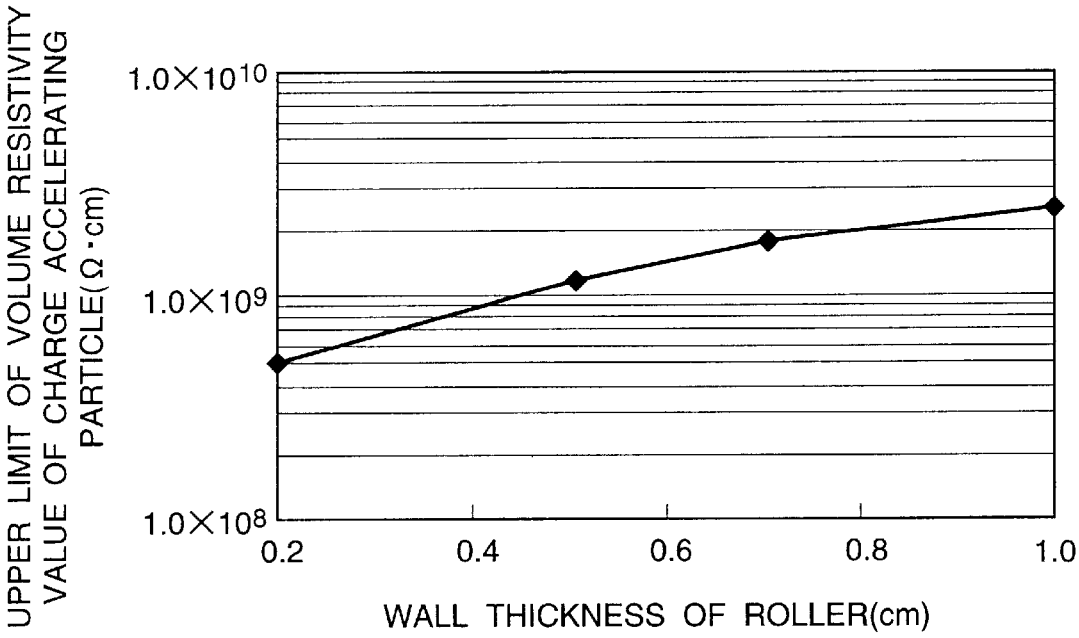
FIG. 4 is a correlative view (No. 2)
Figure 5:
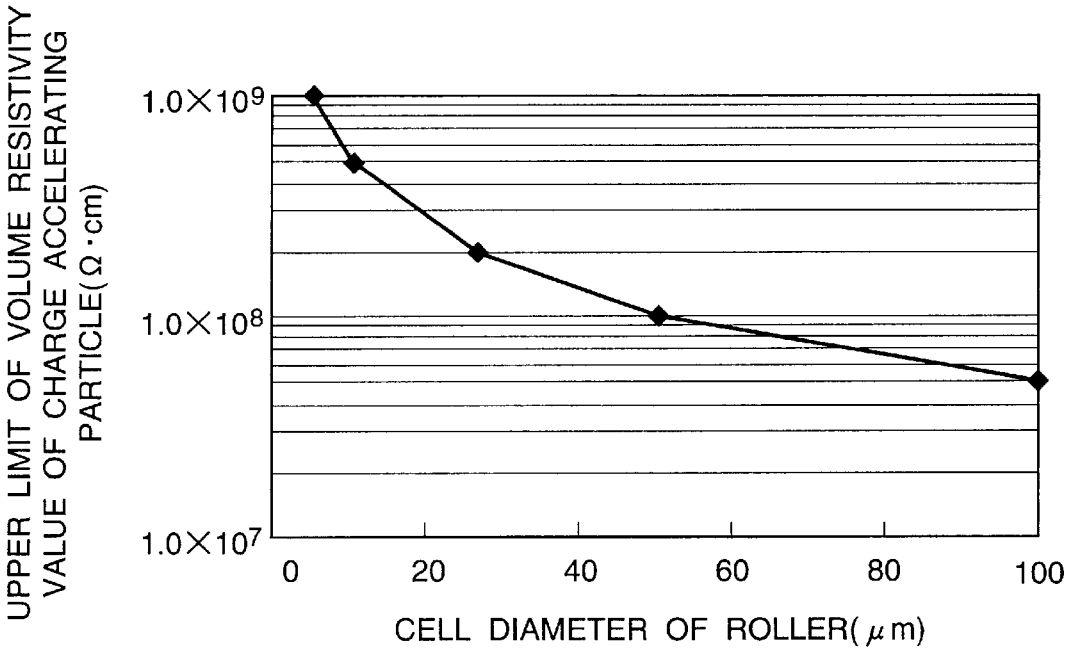
FIG. 5 is a correlative view (No. 3)

Relationship wherein, regarding the resistivity value (Ω·cm) of the electrically conductive elastic sponge roller, roller thickness (cm) and cell diameter, good charging ability can be obtained when charge accelerating particles having which resistivity value is used are shown in FIGS. 3 to 5.

FIG. 3 shows available upper limit of the resistivity value of the charge accelerating particles when the volume resistivity value (Ω·cm) is changed, FIG. 4 shows available upper limit of the resistivity value of the charge accelerating particles when the roller thickness (cm) is changed, and FIG. 5 shows available upper limit of the resistivity value of the charge accelerating particles when the cell diameter (cm) is changed.

Figure 6:
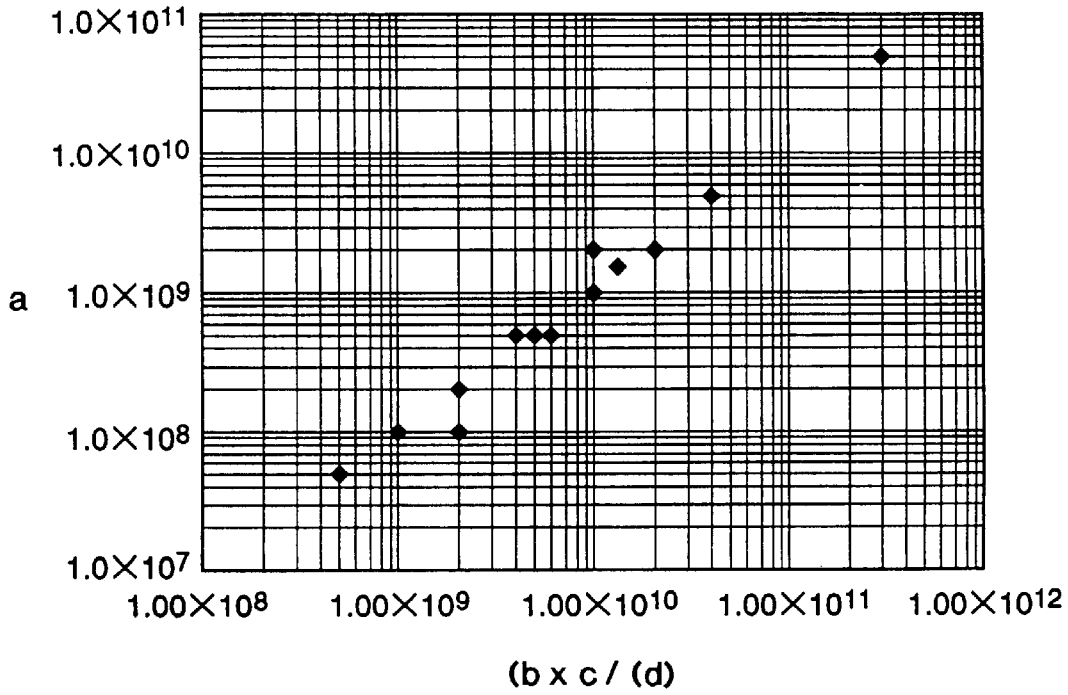
FIG. 6 is a correlative view (No. 4)

Further, in order to check the proportional constant between these relationships, a relationship between [(b×c)/(d)] and [a] is shown in FIG. 6. The abscissa indicates [(b×c)/(d)] and the ordinate indicates [a].

From FIGS. 3 to 5, it can be seen that the preferred resistivity value a of the charge accelerating particles is proportional to the volume resistivity value b (Ω·cm) of the roller and the thickness c (cm) of the roller and is in inverse proportion to the cell diameter d (cm) of the roller. Further, as shown in FIG. 6, the proportional constant is substantially shown in 1/10, and, as is in the illustrated embodiment, by using the contact type charging member satisfying the following relationship, good charging ability can be obtained:

$$a \leqq [(b \times c)/(10 \times d)]$$

As a result, a good image can be obtained.

Incidentally, in the illustrated embodiment, while an example that the charge accelerating particles m are supplied from the developing device 3 was explained, the present invention is not limited to such an example, but a supplying device may be provided at the charging portion.

Further, the materials of the electrically conductive elastic sponge roller 2 and the charge accelerating particles m are not limited to those in the illustrated embodiment.

<Second Embodiment>

According to a second embodiment of the present invention, in the image forming apparatus shown in the first embodiment, by adjusting surface resistance of outermost surface layer of the photosensitive body (body to be charged) 1, further stable and uniform charging is realized.

That is to say, by setting the surface resistance of the photosensitive body 1 to a smaller value in the latent image formable area, the difference between the direct contact resistivity value A and the indirect contact resistivity value B is more reduced, thereby obtaining good charging ability.

Incidentally, the image forming apparatus used in the second embodiment is substantially the same as the image forming apparatus used in the first embodiment, and only the surface resistance of the outermost surface layer is differentiated.

That is to say, in the second embodiment, the resistance of the surface of the photosensitive body is adjusted by providing a low resistance layer on the surface of the photosensitive body 1.

Figure 7:
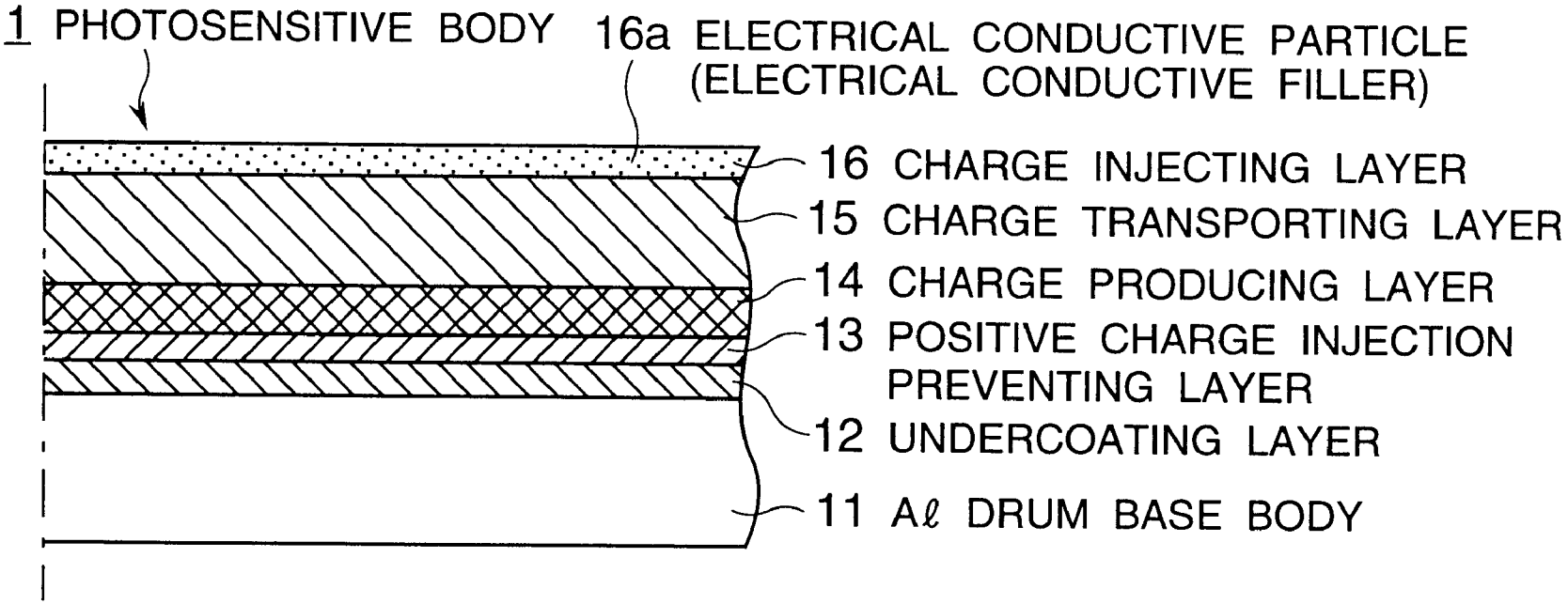
FIG. 7 is a schematic constructural view showing an example of a photosensitive body having a charge injecting layer at a surface thereof, in a second embodiment of the present invention.

FIG. 7 is a schematic view showing a layer structure of the photosensitive body 1 having the low resistance surface layer used in the second embodiment. An undercoating layer 12, a positive charge injection preventing layer 13, a charge producing layer 14 and a charge transporting layer 15 are successively coated on an aluminum drum substrate 11 to obtain a usual organic photosensitive body. And, the charging ability is improved by coating a charge injecting layer 16.

The charge injecting layer 16 is obtained by mixing and dispersing $SnO_2$ super-fine particles 16*a* (having diameter of about 0.03 μm) as electrically conductive particles (electrically conductive filler), lubricating agent such as polytetrafluoroethylene (Teflon: brand name) and polymerization starting agent into photo-curable acrylic resin as binder, and by forming a film by a photo-curing method after coating.

The important feature of the charge injecting layer 16 is resistance of the surface layer. Since the charges are injected to the point B on the surface of the photosensitive body subjected to the indirect contact resistivity value B as described in the first embodiment through the point A on the surface of the photosensitive body subjected to the direct contact resistivity value A, the indirect contact resistivity value B can substantially be reduced. As a result, the difference between the direct contact resistivity value A and the indirect contact resistivity value B can be reduced, thereby obtaining uniform and good charging ability.

Regarding the surface resistance of the surface layer of the photosensitive body, since the electrostatic latent image must be held for a predetermined time period, the volume resistivity value of the charge injecting layer 16 is preferably within a range from $1\times10^{9}$ to $1\times10^{14}$ (Ω·cm)

Further, unlike to the illustrated structure, even when the charge injecting layer 16 is not used, for example, if the charge transporting layer 15 has resistivity value within the above range, equivalent effect can be achieved.

Further, by using amorphous silicone photosensitive body having surface layer volume resistivity value of about $10^{13}$ Ω·M, similar effect can be obtained.

Figure 8:
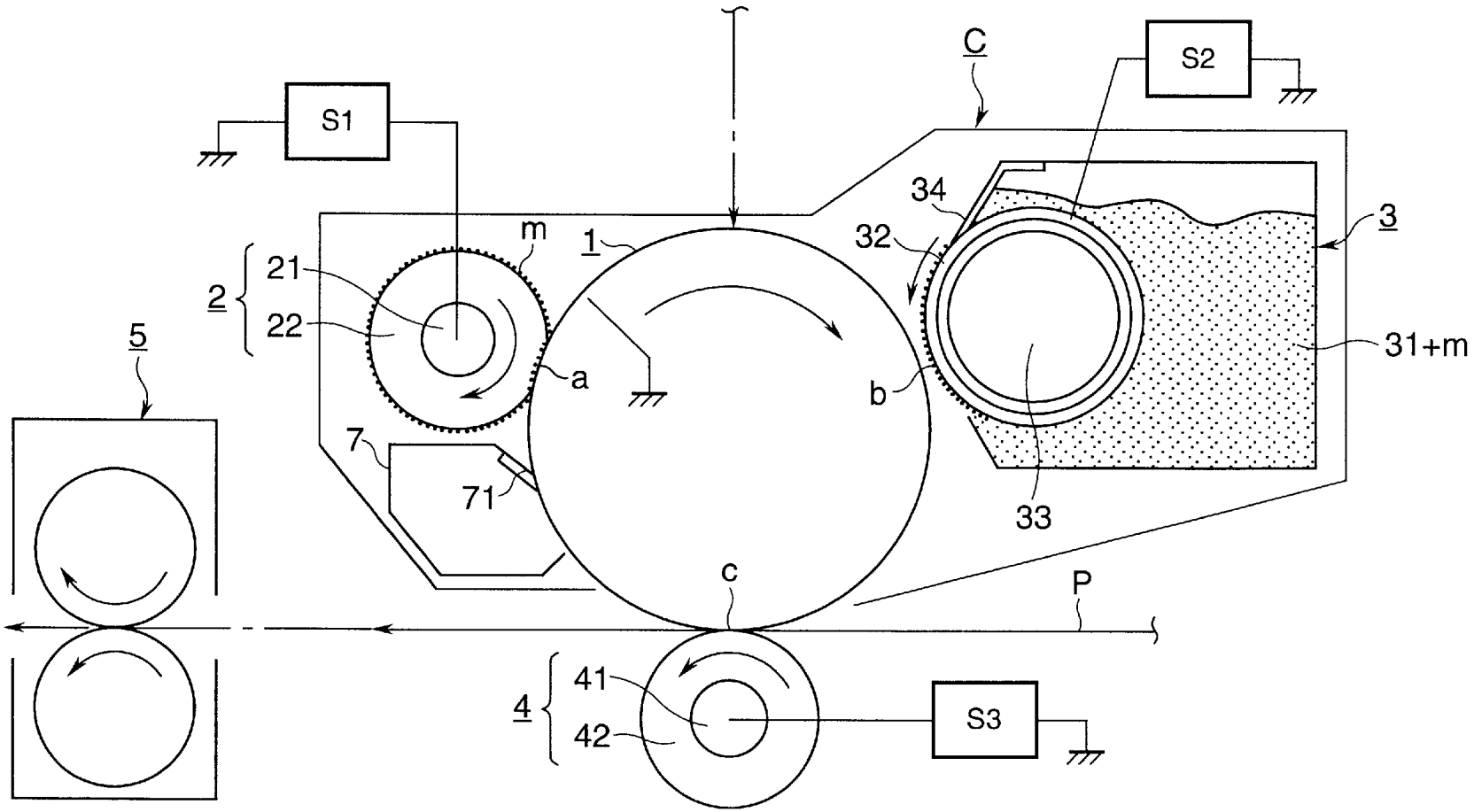
FIG. 8 is a schematic constructural view of an image forming apparatus according to a third embodiment of the present invention.

<Third Embodiment> (FIG. 8)

According to an image forming apparatus of a third embodiment of the present invention shown in FIG. 8, in the image forming apparatus in the first or second embodiment, there is provided a cleaning device (cleaner) 7 for removing transfer-residual developer and paper powder from the surface of the photosensitive body 1 (after transferring) to clean the photosensitive body 1 between the transfer portion c and the charging nip portion a.

Since the other constructions of the apparatus are the same as those of the image forming apparatus in the first or second embodiment, explanation thereof will be omitted.

The cleaning device 7 according to the third embodiment utilizes a cleaning blade 71 for cleaning the photosensitive body 1. The cleaning blade 71 is an elastic blade made of urethane rubber. By urging the cleaning blade against the photosensitive body 1, the transfer-residual developer and paper powder remaining on the surface of the photosensitive body 1 after the transferring are removed from the surface of the photosensitive body 1.

Accordingly, in comparison with the printer of cleanerless type, entering of the transfer-residual developer and paper powder into the charging nip portion a is greatly reduced, thereby obtaining good charging ability and stable image.

In this case, even when the cleaning device 7 is provided, among the transfer-residual developer, paper powder and charge accelerating particles remaining on the surface of the photosensitive body 1 after the transferring, since the charge accelerating particles has smaller particle diameter than those of the developer and paper powder, the charge accelerating particles can easily pass through the cleaning device 7 to reach the charging nip portion a.

Accordingly, even when the cleaning device 7 is provided, the charge accelerating particles m (mixed with the developer 31 in the developing device 3) supplied and adhered to the surface of the photosensitive body 1 at the developing station b are brought to the charging nip portion a through the transfer portion c as the surface of the photosensitive body 1 is shifted, with the result that the charge accelerating particles are automatically supplied to the charging nip portion a and the charging roller 2, thereby maintaining good charging ability.

Further, since the charge accelerating particles m are adhered to the contact portion between the cleaning blade 71 and the surface of the photosensitive body 1, the cleaning blade 71 is prevented from being warped by the friction of the photosensitive body 1 and/or unevenness of the rotation of the photosensitive body 1 is prevented. Thus, the good image can be obtained.

That is to say, in the conventional techniques, when the cleaning device 7 having the cleaning blade 71 was used, if sliding ability of the surface of the photosensitive body 1 was poor, the cleaning blade 71 would be warped and/or unevenness of the rotation of the photosensitive body 1 would occur. However, in the illustrated embodiment, the charge accelerating particles m are adhered to the surface of the photosensitive body 1 to be located between the cleaning blade 71 and the photosensitive body 1. Thus, the sliding ability is enhanced, with the result that the cleaning blade 71 is prevented from being warped by the friction of the photosensitive body 1 and/or unevenness of the rotation of the photosensitive body 1 is prevented.

<Others>

(1) The electrically conductive and flexible contact type charging member 2 having the porous member is not limited to the electrically conductive elastic sponge roller described in the embodiments. The charging member may be formed from felt, cloth and the like. Further, by laminating these materials, more proper elasticity and conductivity can be obtained.

(2) When the AC voltage (alternate voltage) is applied to the contact type charging member and the developing device, a wave form of the AC voltage may be a sine wave, rectangular wave or triangular wave. Further, a rectangular wave formed by turning ON/OFF a DC power source periodically may be used. In this way, as the wave form of the alternate voltage, bias having a voltage value changed periodically can be used.

(3) The image exposure means for forming the electrostatic latent image is not limited to the laser scanning exposure means for forming the digital latent image as described in the embodiments, but conventional analogue image exposure or other light emitting elements such as LED may be used. Alternatively, so long as the electrostatic latent image corresponding to the image information can be obtained, a combination of a light emitting element such as a fluorescent lamp and a liquid crystal shutter, or the like may be used.

The image bearing body 1 may be electrostatic recording dielectric body. In this case, after a surface of the dielectric body is uniformly primary-charged with predetermined polarity and potential, a target electrostatic latent image is written by selectively removing electricity by means of an electricity removing means such as an electricity removing needle head or an electronic gun.

(4) Of course, the developing system of the developing device 3 is not limited to the illustrated one. A developing device of contact type may be used. Normal developing means also may be used.

(5) The recording medium to which receives the developer image from the image bearing body 1 may be an intermediate transfer body such as a transfer drum.

An image forming apparatus of direct type may be used.

(6) An example of a method for measuring particle size of the developer (toner) 31 will now be described. A Coulter counter TA-2 type (manufactured by Coulter K.K.) is used as a measuring device to which an interface (manufactured by Nikkaki K.K.) for outputting number average distribution and volume average distribution and a CX-1 personal computer (manufactured by Canon K.K.). Electrolytic solution is adjusted to 1% Nacl aqueous solution by using first class sodium chloride.

In the measurement, surface-active agent (preferably, alkyl benzene sulfonate) of 0.1 to 5 ml as dispersing agent is added to the electrolytic solution of 100 to 150 ml, and further, specimen to be measured of 0.5 to 50 mg is added.

The electrolytic solution in which the specimen is suspended is subjected to dispersing treatment for 1 to 3 minutes by a ultrasonic dispersing device, and particle size distribution of particles of 2 to 40 $\mu$m is measured by the Coulter TA-2 type using 100 $\mu$p aperture, thereby seeking volume average distribution. Volume average particle diameter is obtained on the basis of the sought volume average distribution.

As mentioned above, according to the present invention, also in the contact charging, even when the simple member such as the sponge roller is used as the charging member, the injection charging which has excellent uniform charging ability, is stabilized for a long term, has low applied voltage and is ozoneless can be achieved.

As a result, in image forming apparatuses of contact charging type using a contact type charging apparatus as a charging means for an image bearing body and process cartridges or in image forming apparatuses of contact charging type, transfer type and cleanerless type and process cartridges, by using the simple member such as the sponge roller as the contact type charging member, regardless of developer contamination on the contact type charging member, ozoneless injection charging having low applied voltage and a cleanerless system can be realized without any problem, with the result that image formation with high quality can be maintained for long term, and, even after images having high image ratio are outputted, image formation with high quality can be maintained for along term.

While the present invention was explained in connection with the embodiments thereof, the present invention is not limited to such embodiments, but various alterations can be made within the scope of the invention.

What is claimed is:

1. A charging apparatus comprising:

a body to be charged; and charging means for charging said body to be charged, said charging means including a charging member which has a foam body surface layer which closely contacts said body to be charged and an electrically conductive particle layer covering a surface of said charging member;

wherein said charging means injects an electric charge to said body to be charred via the electrically conductive particle, and wherein, when a is a volume resistivity value (Ωcm) of the electrically conductive particles, b is a volume resistivity value (Ωcm) of the foam body surface layer, c is a thickness (cm) of the foam body layer and d is a diameter (cm) of the cell, the following relationship is satisfied:

$$a \leqq bc/10d.$$

2. A charging apparatus according to claim 1, wherein said charging member has an electrically conductive core material, and the foam body layer is provided on said electrically conductive core material.

3. A charging apparatus according to claim 1, wherein the volume resistivity value of the electrically conductive particles is $10^{12}$ Ω·cm or less.

4. A charging apparatus according to claim 1, wherein the volume resistivity value of the electrically conductive particles is greater than the volume resistivity value of the foam body layer by ten times or more.

5. A charging member for holding electrically conductive particles, comprising:

an electrically conductive core material;

a foam body surface layer having cells holding the electrically conductive particles; and an electrically conductive particle layer covering a surface of the foam body, wherein, when a is a volume resistivity value (Ω·cm) of the electrically conductive particles, b is a volume resistivity value (Ω·cm) of the foam body surface layer, c is a thickness (cm) of the foam body surface layer and d is a diameter (cm) of the cell, a relationship $bc/10d \geqq a$ is satisfied.

6. A charging member according to claim 5, wherein the foam body surface layer is provided on said electrically conductive core material.

7. A charging member according to claim 5, wherein the volume resistivity value of the electrically conductive particles is $10^{12}$ Ω·cm or less.

8. A charging member according to claim 5, wherein the volume resistivity value of the electrically conductive particles is greater than the volume resistivity value of the foam body surface layer by ten times or more.

* * * * *

UNITED STATES PATENT AND TRADEMARK OFFICE

CERTIFICATE OF CORRECTION

PATENT NO. : 6,212,346 B1
DATED : April 3, 2001
INVENTOR(S) : Jun Hirabayashi et al.

It is certified that error appears in the above-identified patent and that said Letters Patent is hereby corrected as shown below:

Column 5,
Line 6, "an" should read -- a --;
Line 8, " The transferring" should read -- The transferring --; and Column 6,
Line 47, "an" should read -- a --.

Column 8,
Line 9, "rate" should read -- rating --; and
Line 12, "not" should read -- not be --.

Column 14,
Line 42, "along" should read -- a long --; and
Line 58, "charred" should read -- charged --.

Signed and Sealed this

Second Day of April, 2002

*Attest:*

*Attesting Officer*

JAMES E. ROGAN
*Director of the United States Patent and Trademark Office*